US007833130B1

(12) United States Patent
Horvath

(10) Patent No.: US 7,833,130 B1
(45) Date of Patent: Nov. 16, 2010

(54) SIMULATED EDGED WEAPON OR TOY WITH ELEMENT ACTUATED INDICATING DEVICE

(76) Inventor: Dwayne A Horvath, 429 route 625, Pittstown, NJ (US) 08867

( * ) Notice: Subject to any disclaimer, the term of this patent is extended or adjusted under 35 U.S.C. 154(b) by 1301 days.

(21) Appl. No.: 10/763,906

(22) Filed: Jan. 23, 2004

(51) Int. Cl.
*A63B 69/00* (2006.01)

(52) U.S. Cl. ..... 482/12; 482/83; 482/84

(58) Field of Classification Search ..... 434/11, 434/22; 446/473, 175
See application file for complete search history.

(56) References Cited

U.S. PATENT DOCUMENTS 2,206,697 A * 7/1940 Harter ..... 482/8
2,294,026 A 8/1942 de Tuscan
2,885,779 A 1/1957 Newkirk
3,755,893 A 9/1973 Nagaki
4,328,966 A 5/1982 Miyamoto
4,364,104 A * 12/1982 Holahan et al. ..... 362/223
4,383,386 A 5/1983 Giordano
4,558,609 A * 12/1985 Kim ..... 74/471 XY
4,678,450 A 7/1987 Scolari
4,772,028 A * 9/1988 Rockhold et al. ..... 463/5
4,892,303 A 1/1990 Lohre
5,060,379 A 10/1991 Neely
5,174,756 A 12/1992 Taylor
5,288,274 A 2/1994 Bell
5,402,575 A 4/1995 Maxy
6,293,684 B1 9/2001 Riblett
6,352,465 B1 3/2002 Heymann
6,434,829 B1 8/2002 Chen
6,497,619 B2 12/2002 Dowdy

* cited by examiner

*Primary Examiner*—Xuan M Thai
*Assistant Examiner*—Evan R Page
(74) *Attorney, Agent, or Firm*—Kolisch Hartwell, P.C.

(57) ABSTRACT

A simulated sharp edged weapon or toy comprising a housing, an element mounted in and extending from said housing arranged such that said element has movement in relation to said housing in response to force upon said element, an electrical circuit mounted in said housing for providing an indication upon activation having a movement sensor actuator mounted in cooperation with said element to turn on at least one indicating device providing indication of movement of said element.

35 Claims, 6 Drawing Sheets

FIG. 1
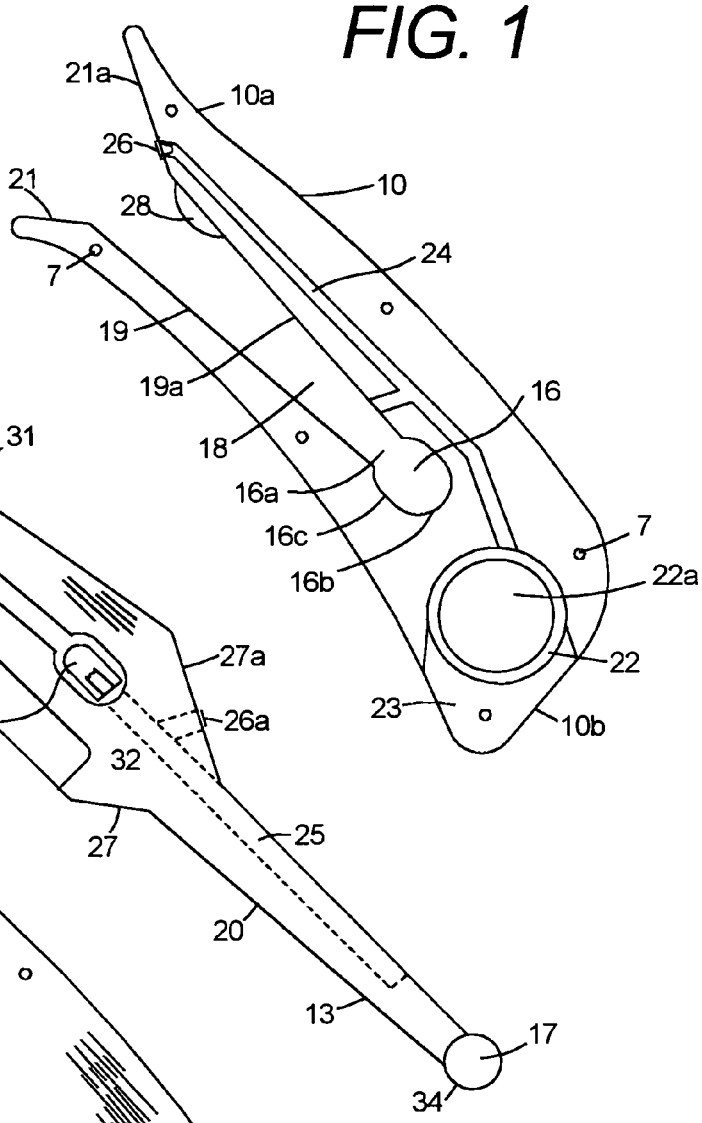
FIG.1A
FIG.1B
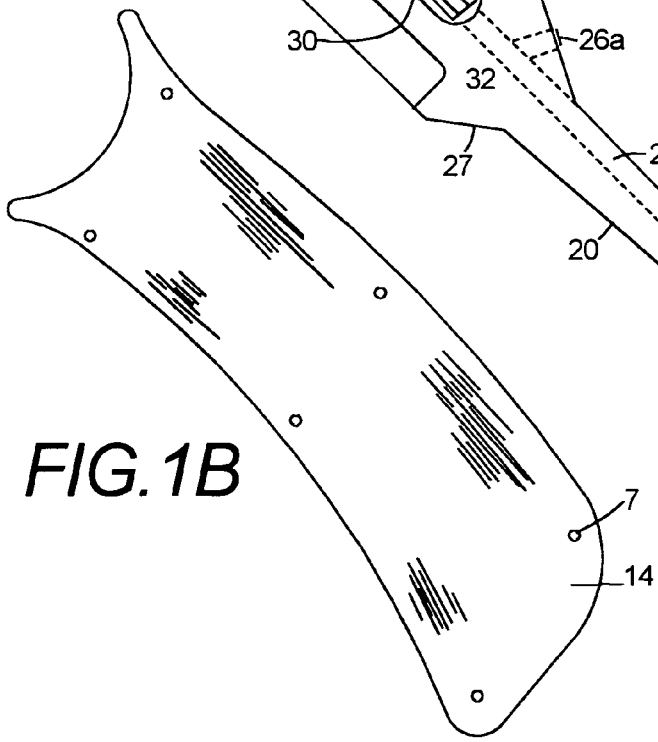

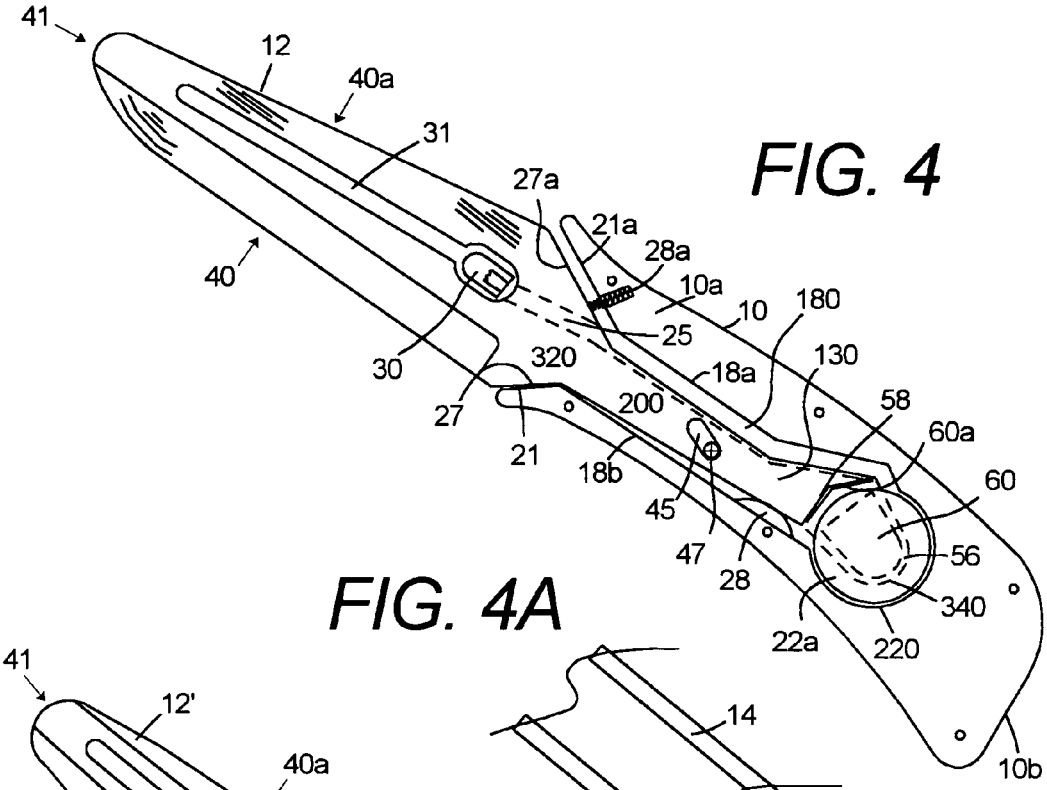
FIG. 4
FIG. 4A
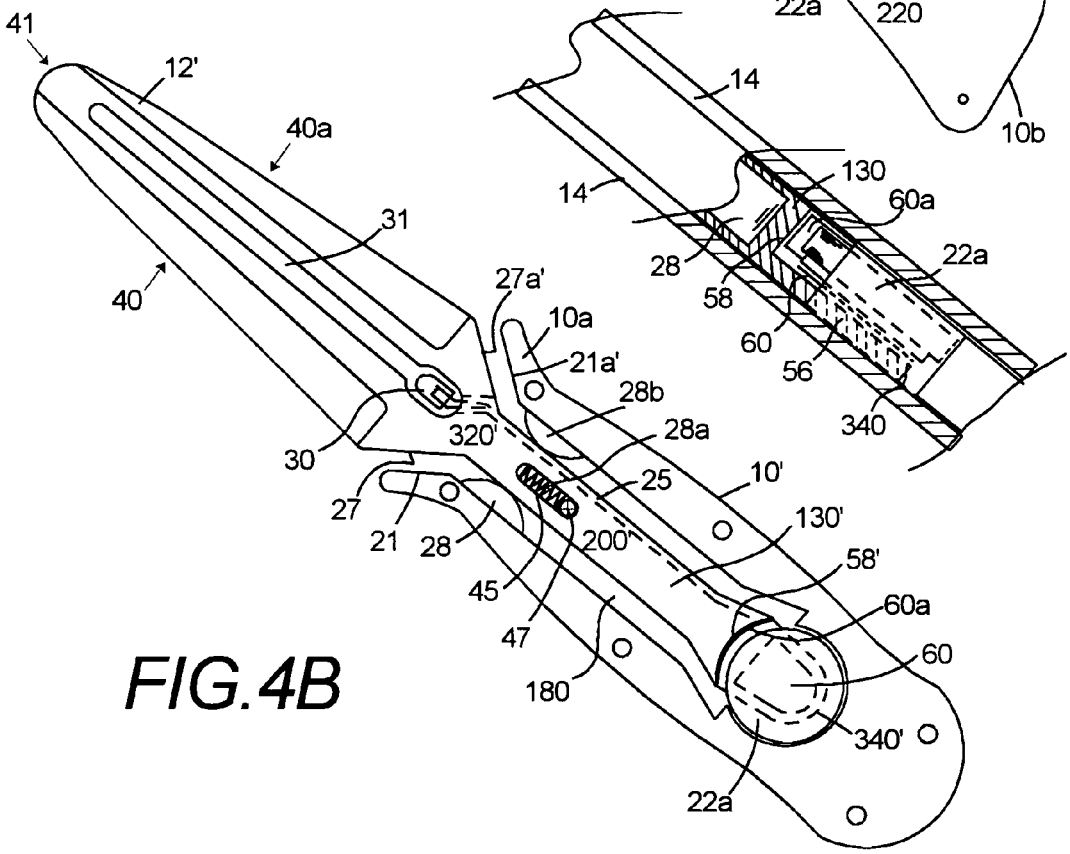
FIG.4B

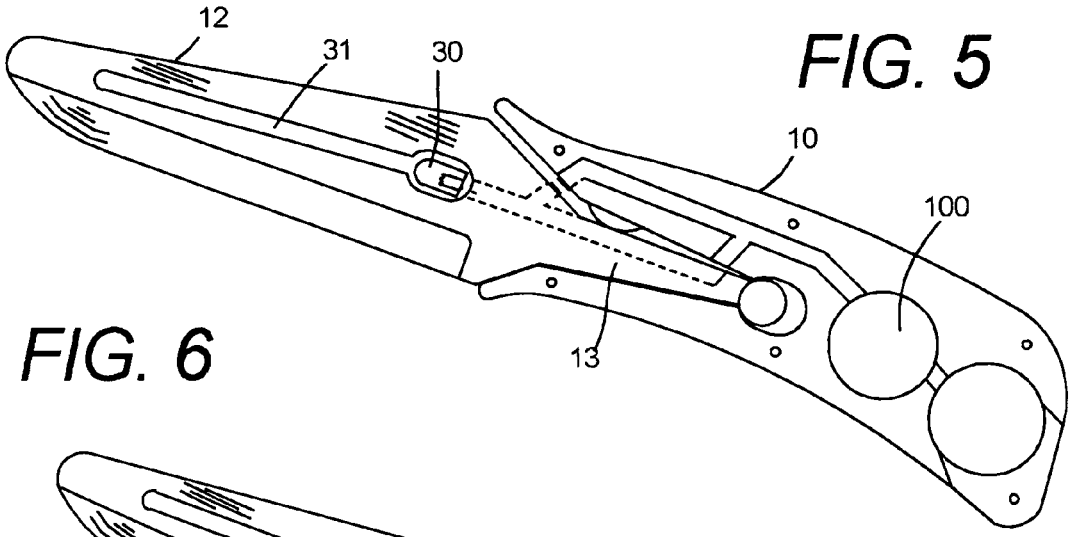
FIG. 5
FIG. 6
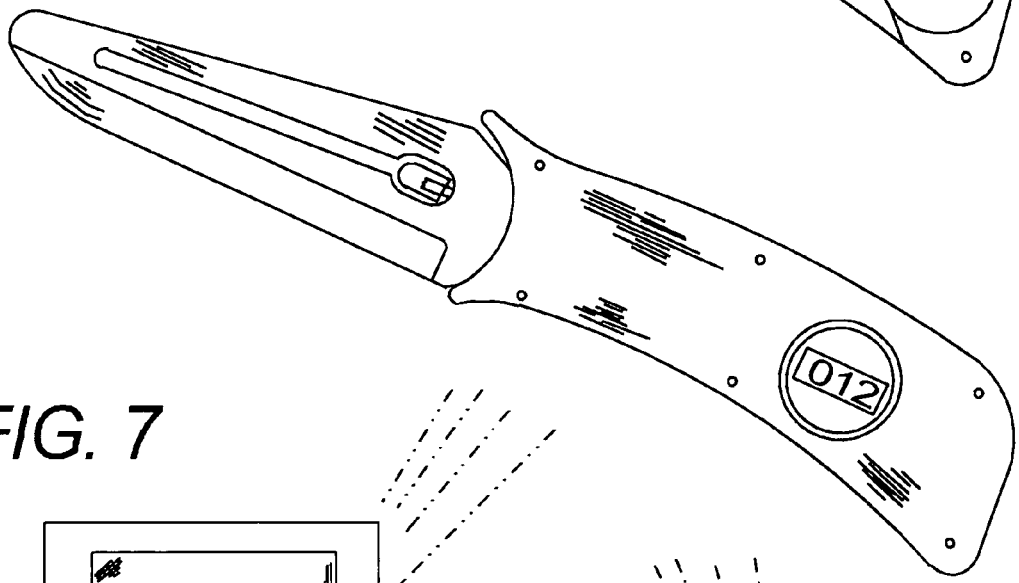
FIG. 7
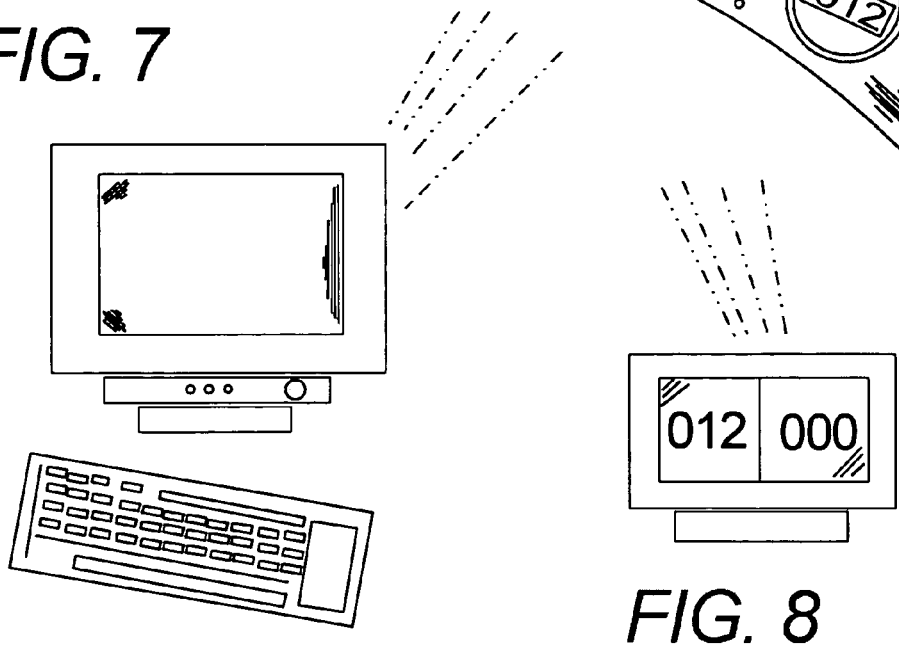
FIG. 8

SIMULATED EDGED WEAPON OR TOY WITH ELEMENT ACTUATED INDICATING DEVICE

CROSS REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

The present invention relates generally to an apparatus simulating an edged weapon or toy wherein the same is arranged to alert contact.

2. Discussion of Prior Art

A large number of groups teach knife self-defense and combat training, including martial arts schools, law enforcement and the military. Most groups use wooden knives, rubber knives, or dull aluminum knives. More recently marking devices have been used show where the element makes contact, however a marking device stains, not only on ones clothing but also on the mat and anything else it touches.

Some exercises start with the knife touching a body part simulating a threat, in this case, the ink marking devices would leave a mark on ones throat or arm before the defensive exercise begins and would not be realistic. These marking devices also need to be refilled or a coating reapplied to the device. When marking devices are not in use, a sheath is also needed to prevent marking.

These devices being used in a game or competition also have no way to convey a strike electronically to an indicating device(s) or wireless remote receiver(s). Since a judge or judges are required to visually confirm the first strike, this can be hard to see in the fast movement of competition thereby being subject to human error.

Other dull element training or toy knives have no means to convey contact at all. In a class or group setting, the instructor has no way of readily seeing who is being cut or stabbed to correct mistakes.

In different training situations or games the need arises to have a variety of blades or elements mirroring the situation. Harder contact requires softer elements, simulated threats require a firmer element, and some situations require a combination of both. None of the present inventions offer the element or blades to be interchanged.

Thus, the need exists for a simulated sharp edged weapon or toy that is more realistic in alerting of strikes or contact with the edge, and teaches safe proper handling of a sharp edged weapon.

U.S. Pat. No. 6,497,619 to Dowdy discloses a simulated striking apparatus that uses a chalk or marking agent applied to the edge of the apparatus. A protective body covering or light colored clothing is recommended to visually see the mark upon contact and needs to be erased. This design suffers from several weaknesses. In training or in a game, action must be stopped to erase the inflicted marks on your protective clothing.

Many times a mark is delivered to a body part not protected such as a hand, finger, arm, neck, etc. and would also need to be erased if the mark can be seen or is left at all. In competition, strikes can be delivered so quickly thus making it difficult to determine who was struck first without the use of an electronic signaling device. In use when performing training drills, moves or strikes are performed in repetition as well as general self defense drills practiced requiring blade contact to a body part first, making training unrealistic as well as uncomfortable and leaving marks all over ones body.

U.S. Pat. No. 6,352,465 to Hermann, U.S. Pat. No. 5,174,756 To Taylor and U.S. Pat. No. 5,288,274 to Bell discloses ink or fluid used to convey contact and suffers from similar disadvantages as detailed above.

OBJECTS OF THE PRESENT INVENTION

Accordingly, in view of the foregoing disadvantages in the prior art, it is a general object of the present invention to provide more realism and feedback while maintaining a degree of safety in a simulated sharp edged weapon.

Accordingly, an object of the invention is to provide a training weapon that produces a clearly recognizable sensory signal or signals.

Another object of the present invention is to provide a training weapon or toy that can be scored locally or remotely.

Another object of the present invention is to provide a training weapon or toy that contains a resilient structure increasing the degree of safety of strikes.

Another object of the present invention is to provide a training weapon or toy that can alert of contact or strike, from a distance.

Another object of the present invention is to provide a training weapon, toy or game that teaches and alerts in the proper use of a sharp edged weapon.

Another object of the present invention is to provide a training weapon or toy with interchangeable elements for different training needs.

Another object of the present invention is to provide a toy to be used in a game of tag.

Further objects and advantages of my invention will become apparent from a consideration of the drawings and ensuing description.

SUMMARY OF THE INVENTION

A simulated sharp edged weapon or toy comprising a housing, an element mounted in and extending from said housing arranged such that said element has movement in relation to said housing in response to a force upon said element, an electrical circuit mounted in said housing for providing an indication upon activation having a movement sensor actuator mounted in cooperation with said element to turn on at least one indicating device providing indication of movement of said element.

BRIEF DESCRIPTION OF THE DRAWINGS

FIGS. 1, 1A and 1B is an exploded view of the preferred embodiment of the simulated sharp edged weapon or toy according to the present invention;

FIG. 1 is a perspective view of the housing of the preferred embodiment;

FIG. 1A is a perspective view of the element of the preferred embodiment;

FIG. 1B is a perspective view of the housing cover of the preferred embodiment;

FIG. 4 is a perspective view of an alternative embodiment of the simulated sharp edged weapon;

FIG. 4A is a sectional view of the motion sensor actuator of the alternative embodiment;

FIG. 4B is another alternative embodiment of the simulated sharp edged weapon;

FIG. 5 is a perspective view of the housing and element showing another alternative embodiment containing more than one indicating devices;

FIG. 6 is a perspective view one embodiment of the assembled simulated sharp edged weapon including a scoring device or counter;

FIG. 7 is a computer as an indicating device;

FIG. 8 is a remote indicating device for indicating or scoring;

DETAILED DESCRIPTION OF THE PREFERRED EMBODIMENT

Figure 2:
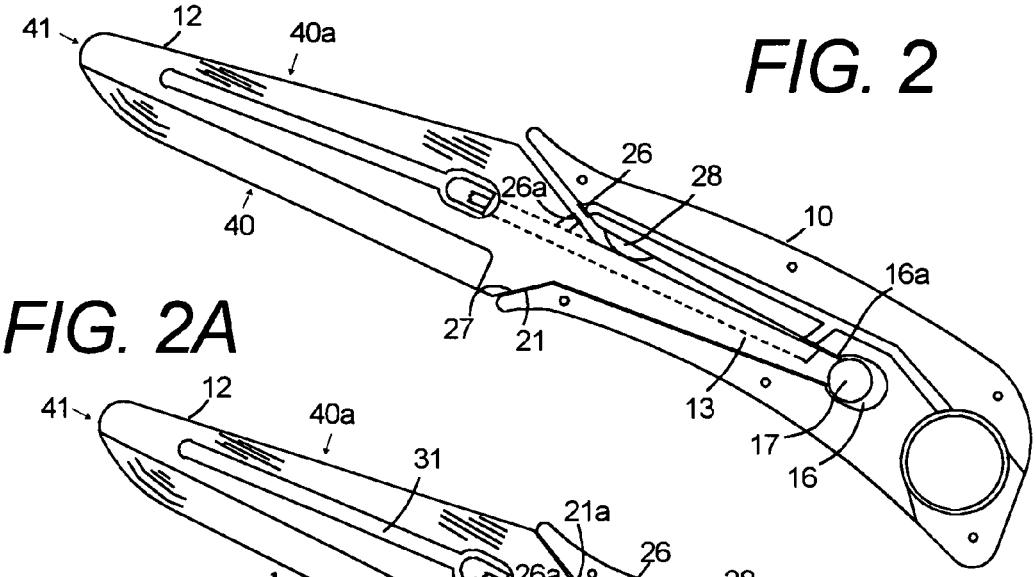
FIG. 2 is a perspective view and operation of the housing and element in an unswitched resting position of the preferred embodiment.

Referring to FIGS. 1, through 1B, in the preferred embodiment there is shown an exploded view of a housing 10, an element 12, and a housing cover 14.

The housing 10 having a forward end 10*a* and a rearward end 10*b*. The housing a can be made from a single piece needing one or two covers 14 secured by screws or rivets through holes 7. The element 12 having a tang 13 is moveably mounted generally to the rearward end 10*b* in the housing 10 by an elongate shaped cutout 16 generally disposed longitudinally having a forward 16*a* end, rearward end 16*b*, and a width 16*c*. The forward end 16*a* of the elongate shaped cutout 16 having an opening is connecting to a cutout 18 in the shape of a wedge having a bottom wall 19 and a top wall 19*a*. The point of intersection being no wider than the width of the elongate shaped cutout 16. The wedged shaped cutout 18 continues towards the forward end 10*a* in the housing 10 intersecting a larger angled wedged shaped cutout 21 and 21*a*. This larger angled wedged shaped cutout continues through to the outer edges of the housing 10, the overall general appearance resembles the shape of a Y.

An electrical circuit for providing an indication upon activation is mounted in the housing 10. The housing 10 includes a cutout 22 to house an electrical power source 22*a* generally located near the rearward end of the housing 10*b*. The power source may be a battery 22*a* of the flat type 1032 and is replaceable by removing a section 23 of the housing 10 or the cover 14. The battery may be held into place by a battery retainer (not shown). The battery 22*a* is in electrical connection by wiring, (not shown) run within a channel 24 and a channel 25 in the tang 13 connecting in circuit a movement sensor actuator and at least one indicating device.

In this embodiment, the movement sensor actuator includes a set of contacts 26 and 26*a*. The contact 26 being arranged within the larger angled wedged shaped cutout 21*a* and contact 26*a* on the tang 13 being arranged within the complementary larger angled wedged shaped surface 27*a* working in cooperation with the element 12 to turn on at least one indicating device. The contact 26 is connected to the battery 22*a* by wiring not shown run within the channel 24. Contact 26*a* on the tang 13 is connected to the indicating device by wiring run within the channel 24 crossing to 25 connecting with the battery 22*a*. The movement sensor actuator generally includes any device, apparatus, mechanism, contacts or switch arranged such that can complete and break a circuit in response to movement from a force upon the element 12.

The tang 13 as shown in FIG. 1A having a first end 32 and a second end 34 and middle section 20, is shaped in a similar Y shape as stated above to interconnect with the cutout 18. The difference being the middle section 20 and the complementary larger angled wedged shaped surface 27 and 27*a* are sized to provide for compound movement within the cut out 18 discussed below. In this embodiment, the second end 34 consists of a shaped end 17 that is generally the same width and cylindrical in shape for movably interconnecting within the elongate shaped cutout 16 of the housing 10 creating a moveable pivot point.

A resilient material 28 disposed in an operative location is used to help restore the element to an unswitched resting position. The resilient material 28 may be a shaped wire. The resilient material in this embodiment is operatively disposed in the cutout 18 adjacent the larger angled wedged shaped cutout 21*a* between the top wall 19*a* and the tang 13.

In this embodiment, an LED light source 30 is used as an indicating device mounted within a cutout 31 in the element 12. The cutout 31 can be of different shapes and sizes. The LED is connected to the electrical circuit from wires (not shown) run through ports 25 in the tang 13 from the channel in the housing 24.

In operation, referring to FIG. 2, in an unswitched resting position the tang 13 and housing 10 in this embodiment are configured such that the larger angled wedged shaped cutout 21 and complementary larger angled wedged shaped surface 27 contact each other creating a cam arrangement. The cam arrangement also produces a restoring force retaining the element in an unswitched resting position. This is due to the mechanics of the angles pulling the element 12 out of the housing 10 in combination with the resilient material 28 disposed in an operative location helping to push the element. The shaped end 17 of the tang 13 is resting against the forward end 16*a* of the elongate cutout 16 keeping the element 12 moveably connected to the housing 10. The element now can not move in a downward direction when a force is applied to

40*a* on the element 12. The motion sensor actuator, in this embodiment the set of contacts 26 and 26*a* are in a disconnected state.

Figure 2A:
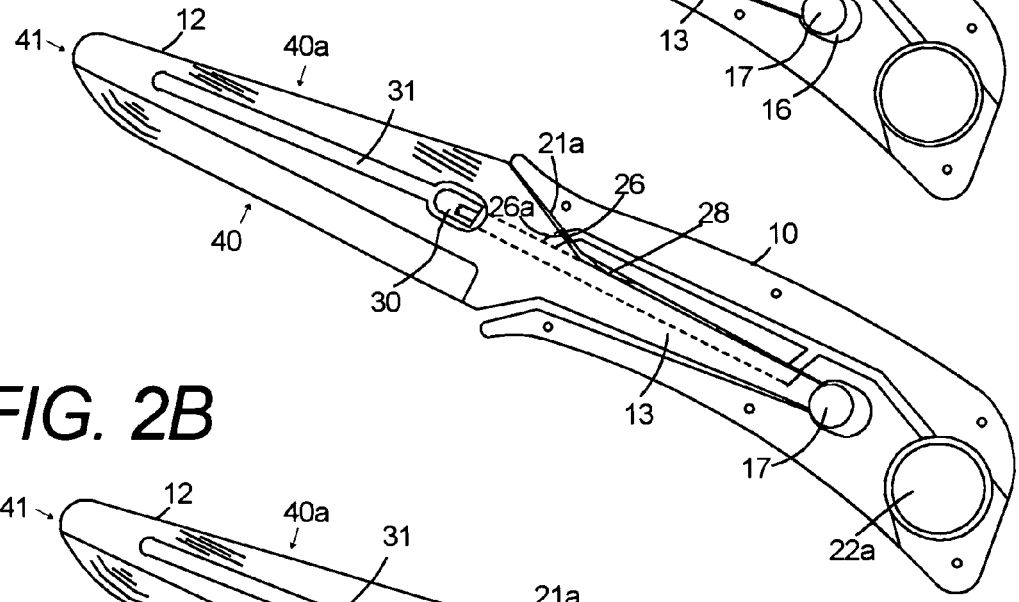
FIG. 2A is a perspective view and operation of the housing and element in response to a force upon the edge of the element of the preferred embodiment.

Referring to FIG. 2A as force is applied to the element 12 in an upward direction 40, The element 12 senses the force and is free to respond and move up in relation to the housing 10, by pivoting around the pivot point 17 and stopping when the tang 13 makes contact with the larger angled wedged shaped cutout 21*a*. The movement sensor actuator, in this embodiment the contacts 26 and 26*a*, mounted in cooperation with the element 12 contact each other actuating the electrical circuit providing the indication by completing the circuit with the power source 22*a*, turning no less than one electrically operated indicating device. This embodiment includes the light source 30, which illuminates the cutout 31. The element 12 is returned to the unswitched resting position as discussed above.

Figure 2B:
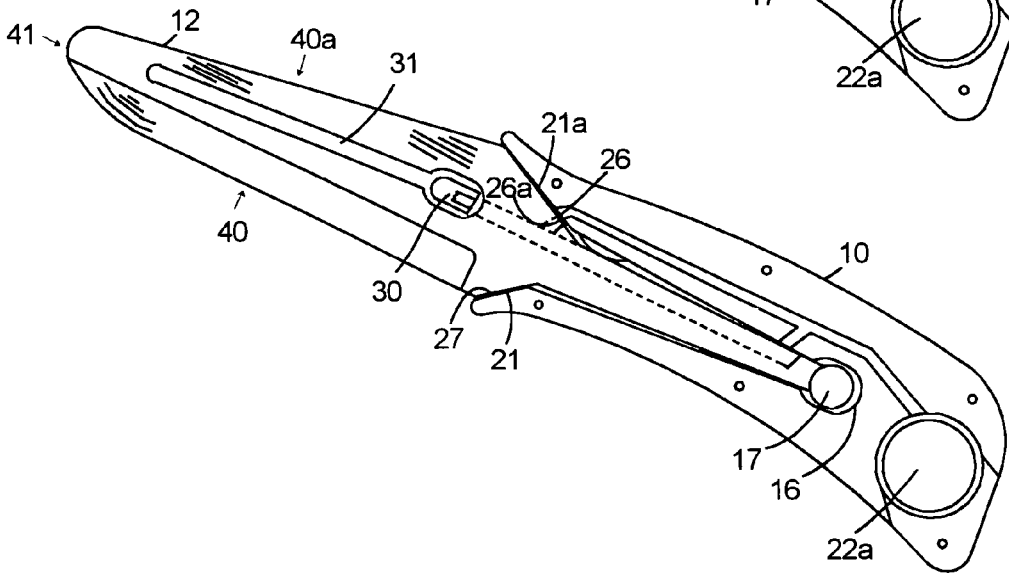
FIG. 2B is a perspective view and operation of the housing and element in response to a force upon the tip of the element of the preferred embodiment.

Referring to FIG. 2B as force is applied to the point 41 of the element 12, in a longitudinal direction in relation to the housing 10, the element 12 senses the force and is free to respond and move in an inward direction in combination with rotating up, stopping when the tang 13 makes contact with the larger angled wedged shaped cutout 21 and 21*a*. The moveable pivot as described above in combination with the cam arrangement creates this compound movement.

In this embodiment, the sliding action of the larger angled wedged shaped cutout 21 within the housing 10 in cooperation with the complementary larger angled wedged shaped surface 27 on the tang 13 urge the tang to move in a generally transverse direction to the housing 10. This cam arrangement produces the restoring force to retain and return the element 12 to an unswitched resting position as detailed above.

The movement sensor actuator, in this embodiment the contacts 26 and 26*a*, mounted in cooperation with the cam arrangement contact each other actuating the electrical circuit providing the indication by completing the circuit with the power source 22*a*, turning no less than one electrically operated indicating device. This embodiment includes the light source 30, which illuminates the cutout 31. The element 12 is returned to an unswitched resting position as discussed above.

While the invention has been described with an emphasis upon a preferred embodiment, many variations of the present invention are possible in light of the above teachings. Thus, it is to be understood that, within the scope of the intended claims, the embodiments are not to be limiting features. Some other embodiments and teachings that can easily be incorporated into the structure of the simulated sharp edged weapon or toy are as follows.

Figure 3:
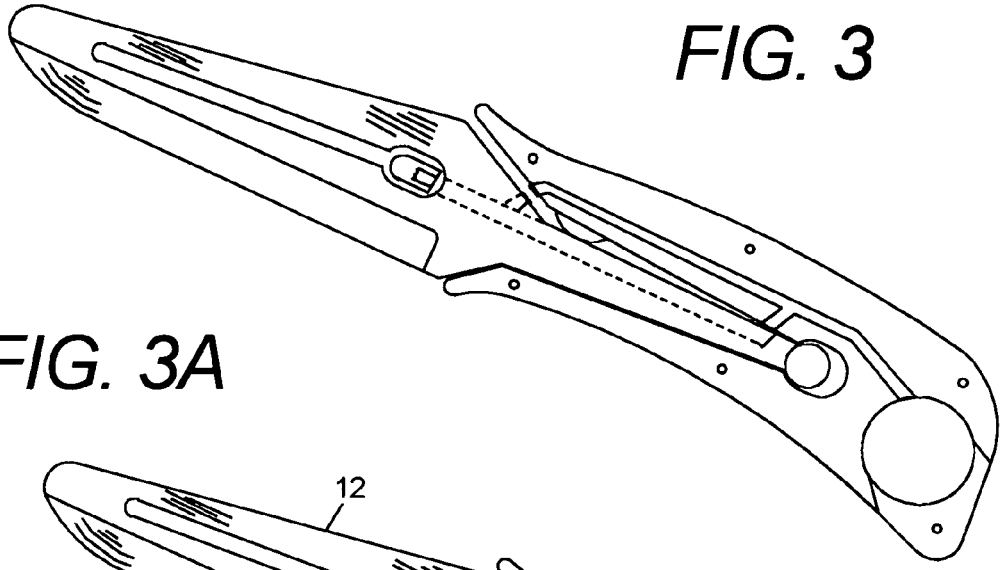
FIG. 3 is a perspective view of the preferred embodiment for comparison to tang connection shown in FIGS. 3A and 3B.

FIG. 3 shows the preferred embodiment described in detail above for comparison.

Figure 3A:
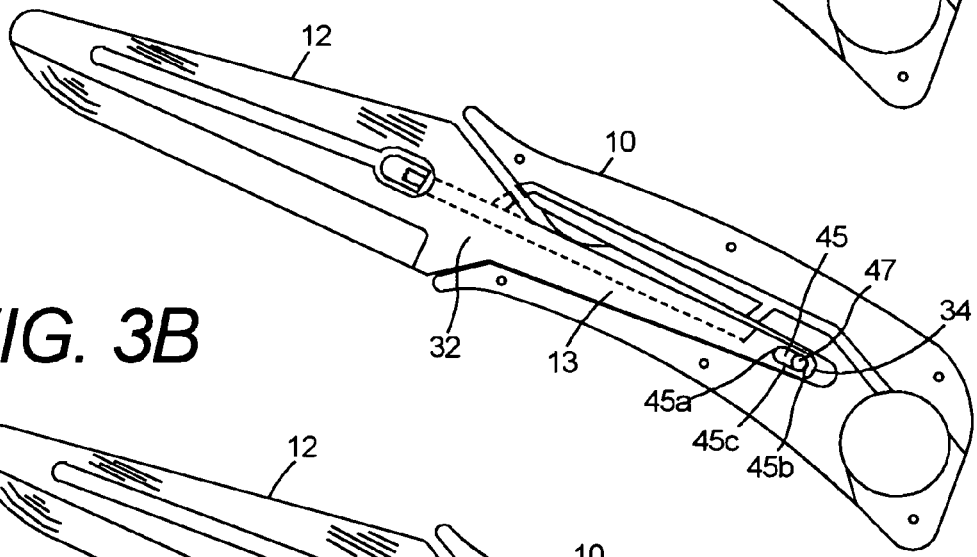
FIG. 3A is a perspective view of the housing and element showing one alternative embodiment of a tang connection.

FIG. 3A shows a second embodiment for moveably retaining the element 12 in the housing 10. This embodiment is similar to the first detailed above with the differences as follows. An elongate slot 45 having a forward end 45*a*, a rearward end 45*b*, and a width 45*c*, is disposed in the tang 13 between the tang first end 32 and second end 34 generally longitudinal to the element 12. In this embodiment the elongate slot is disposed near the second end 34 of the tang 13. A rod 47 being no larger than the elongate slot width 45*c* extends through the elongate slot 45 at the rearward end 45*b* and is secured to the housing 10.

In operation this embodiment works the same as the preferred embodiment with the rod 47 moveably retaining the element 12 in the housing 10. The rod 47 is disposed through the rearward end 45*b* of the elongate slot 45 retaining yet allowing the element 12 to move in compound directions in relation to the housing 10 in response to a force on the element.

FIG. 4 shows yet another embodiment of the elongate slot 45 as described above. The elongate slot 45 and rod 47 is disposed on a bias in the tang 13 in relation to the elements longitudinal axis. This bias produces a cam arrangement urging the element 12 to move in a generally transverse direction in relation to the housing 10. The elongate slot 45 and rod 47 can be configured in varying locations on the tang 13 to produce desired pivoting and cam arrangements. One example will be explained in detail below.

Figure 3B:
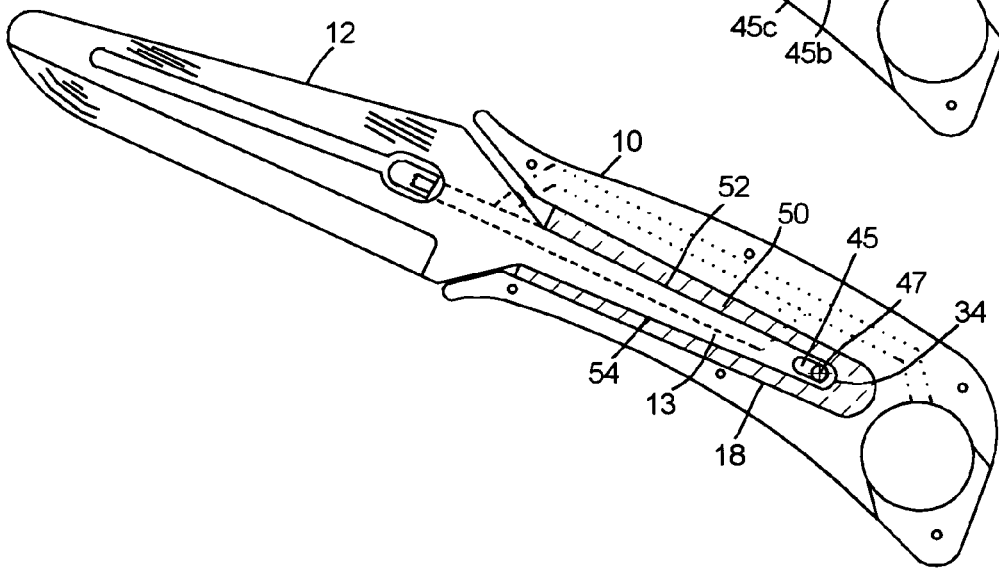
FIG. 3B is a perspective view of the housing and element showing another alternative embodiment of a tang connection.

FIG. 3B shows a third embodiment for moveably retaining the element 12 in the housing 10 with the differences as follows. The tang 13 having a top edge 52 and a bottom edge 54 and the second end 34 is substantially surrounded by a resilient material 50 allowing for movement of the element 12 in relation to the housing 10. The resilient material 50 having a firmness that allows the element 12 to maintain an unswitched position and a softness that allows the element to be moveable in response to a force on the element 12. The cut out 18 in the housing 10 having a complementary shape of the tang 13 to allow for the resilient material 50 to reside between the tang 13 and the cutout 18. This space allows for movement of the element 12 in one or compound directions as detailed above. This embodiment includes the elongate slot 45 and rod 47 as detailed above to retain the element 12 in the housing 10. In use, all workings will be the same as detailed.

FIG. 4 shows a fourth embodiment using some of the teachings previously described. The same identification will be used as on previously described parts. This embodiment including a movement sensor actuator that includes the battery 22*a* and a tang 130 being arranged to contact each other completing the circuit upon movement of the element 12.

The housing rearward end 10*b* contains a cutout 220 generally located towards the rearward end 10*b* to house the battery 22*a*. One side of the cutout is open resembling a C exposing a portion of the battery 22*a* to a forward extending cutout 180 having a top wall 18*a* and a bottom wall 18*b*. Cutout 180 continues forward to the larger angled wedged shaped cutout 21 and 21*a*. The larger angle wedged shaped cutout continues through to the outer edges of the housing 10. The bottom wall 18*b* is a straight cut from angle 21 intersecting the battery cutout 220 opening lower edge. The top wall 18*a* is a straight cut from angle 21*a* to a fin shaped end intersecting the battery cutout 220 upper edge. This fin shaped section can be almost any shape required providing space for movement to accommodate the tang 130 having the shaped end 340.

Tang 130 having a first end 320 a second end 340 and middle 200 is shaped in a similar shape as stated above to fit into the forward cutout 180 allowing space for movement. In this embodiment the elongate slot 45 is disposed on a bias in the middle section 200 of the tang 130 with the forward end 45*a* being inclined. The rod 47 is disposed through the rearward end 45*b* of the elongate slot 47 secured to the housing 10.

Referring to FIGS. 4 and 4A. Showing an enlarged side view of the tang second end 340 sandwiched between the housing covers 14. Tang 130 second end 340 is stepped and in this embodiment on a bias in relation to the longitudinal line of the tang 130 to provide a tab 56 for the battery 22*a* to rest on. The side wall 58 of the tab having a curved or bird mouthed shaped portion as shown in FIG. 4 is spaced away from the battery 22*a* providing a shape suitable to make contact with the battery 22*a* upon predetermined movement of the element 12. The movement sensor actuator in this embodiment includes a contact 60 disposed on the tab 56 and a contact 60*a* disposed on the side wall 58.

In an unswitched state the larger angles 27 and 21 contact each other effecting the cam arrangement as described in the preferred embodiment. The contact surface 60 is connecting the battery 22*a* to at least one indicating device by wiring (not shown) run through a port 25. The contact 60*a* being on the side wall 58 spaced away from the battery 22*a* is not in connection with the battery 22*a* and is in connection with at least one indicating device by wiring (not shown) run through a port 25. The indicating device in this embodiment is the LED light 30. In this embodiment the resilient material 28 disposed between the bottom wall 18*b* and the tang 130 adjacent the battery 22*a* and the shaped wire 28*a* disposed in the larger angle 21*a* contacting the complementary angle 27*a* helping retain and restore the element to an unswitched resting position.

In use, as force is applied to the element 12 in an upward direction 40, the element 12 senses the force and is free to respond and move up in relation to the housing 10, by pivoting around the rod 47 compressing the shaped wire 28*a*. The tang second end 34 moves in a downward direction sliding under the battery 22*a* compressing the resilient material 28. The movement sensor actuator, in this embodiment the contact surface 60*a* mounted on the tab side wall 58 makes contact with the battery 22*a* to actuate the electrical circuit turning no less than one electrically operated indicating device. This embodiment includes the light source 30, which illuminates the cutout 31. The element 12 is returned to an unswitched resting position by the restoring action of the resilient material 28 and 28*a* as detailed above.

As force is applied to the point 41 of the element 12, in a longitudinal direction in relation to the housing 10, the element 12 senses the force and is free to respond and move in an inward and upward direction. The tang second end 340 will move in a downward direction.

This compound movement is created by the cam arrangement of the larger angled wedged shaped cutout 21, and the complementary larger angled wedged shaped surface 27 contacting each other urging the element 12 to slide up in relation to the housing 10 effecting a first cam action. Simultaneously, the elongate slot 45 moves around the rod 47 effecting a second cam arrangement working in combination with the first to actuate the indicating device quicker.

The movement sensor actuator, in this embodiment the contact surface 60*a* mounted on the tab side wall 58 in cooperation with the cam arrangement makes contact with the battery 22*a* to actuate the electrical circuit turning no less than one electrically operated indicating device. This embodiment includes the light source 30, which illuminates the cutout 31. The element 12 is returned to an unswitched resting position by the resilient material 28 and 28*a* as detailed above. Some advantages to this embodiment are fewer parts, ease of assembly due to the wiring being limited to the tang, battery easier to replace, easier to manufacture.

FIG. 4B shows a fifth embodiment that is similar to the fourth with some differences as follows. The element 12' simulates a multiple edged element. Angle 21 on the housing having a corresponding angle 21*a*'. The tang having complementary angles 27 and 27*a*'. The tang second end 340' is shaped similar to the fourth embodiment with the side wall of the tab 58' resembling a semi circle or V shape being in longitudinal alignment with the tang 130'. This configuration allows contact with the battery 22*a* on three sides upon predetermined movements of the tang 130'. In this embodiment the elongate slot 45 is disposed longitudinally generally toward the tang first end 320' secured by the rod 47 being connected to the housing 10'. The resilient material or in this embodiment the shaped wire 28*a* is disposed within the elongate slot 45 pressing between the tang first end 320' and the rod 47. The resilient material 28 and 28*b* is operatively disposed in two places near the forward end 10*a* of the housing 10' in the forward cutout 180' sandwiching the tang first end 320' on both sides. The elongate cutout 45 and rod 47 are disposed generally towards the first end 320' behind the resilient material 28 and 28*b* biasing the middle 200' creating a pivot point for the element 12' to move about. The forward cut out 180' is shaped to accommodate this movement of the element 12' and tang 130' as detailed above.

In an unswitched state contact surface 60 is connecting the battery 22*a* to at least one indicating device by wiring (not shown) run through the port 25. The contact 60*a* being on the side wall 58' spaced away from the battery 22*a* is not in connection with the battery 22*a* and being in connection with at least one indicating device by wiring (not shown) run through the port 25. The indicating device in this embodiment is the LED light 30. In this embodiment the resilient material 28 and 28*a* disposed in the forward cutout 18 sandwiching the tang first end 320 retaining the element in the transverse direction 40 and 40*a*. The shaped wire 28*a* in the elongate slot being in a compressed state pushes on the rod 47 and tang 130' pushing the element 12' away from the housing 10' maintaining a distance between the battery 22*a* and the side wall contact 60*a* maintaining an unswitched state.

In use, as force is applied to the element 12' in an upward direction 40 or downward direction 40*a*, the element 12' senses the force and is free to respond and move in relation to the housing 10', by pivoting around the rod 47 compressing the resilient material 28 or 28*b*. The tang second end 340' moves in the opposite direction sliding under the battery 22*a*. The movement sensor actuator, in this embodiment the contact surface 60*a* mounted on the tab side wall 58 makes contact with the battery 22*a* to actuate the electrical circuit turning no less than one electrically operated indicating device. This embodiment includes the light source 30, which illuminates the cutout 31. The element 12' is returned to an unswitched resting position by the resilient material 28 or 28*b*.

As force is applied to the point 41 of the element 12' in a longitudinal direction in relation to the housing 10', the element 12' senses the force and is free to respond and move in an inward direction compressing the shaped wire 28*a* closing the distance between the side wall contact 60*a* and the battery 22*a* to actuate the electrical circuit, turning no less than one electrically operated indicating device. This embodiment includes a light source 30, which illuminates the cutout 31. The element 12' is returned to an unswitched resting position by the shaped wire 28*a*. Some advantages of this embodiment include ease of manufacture, fewer parts, and multiple edge contact.

Referring now to FIG. 5 is shown one embodiment of the simulated sharp edge weapon or toy discussed above containing a structure to include any number of indicating devices. The structure is identical to the preferred embodiment in FIG. 1 previously detailed including the light source 30 with the addition of an area or space 100 in the rearward end 10*b* of the housing 10. This space can be created by design of the housing 10 or through simply shortening the tang 13. Some indicating devices include a buzzer, a sound chip to alert with a voice or other sound, a wireless transmitting device, a scoring device or counter or a combination thereof. These indicating devices are not shown in this figure due to the known art of installing and wiring such devices. The scoring device or counter is shown in FIG. 6.

A wireless device or receiver is shown in FIG. 7 as a computer to receive and convey indication of movement of the element 12 as well as to keep score in a remote location. Another embodiment of a wireless remote scoring device is shown in FIG. 8 as a device to receive and convey indication of one or more simulated sharp edged weapons or toys movement of the element 12.

In use, when the element moves upon a strike, at least one indicating device will be actuated as detailed above alerting in single or combination by buzzing, beeping, the generated voice saying gotchya, strike, or other audible sound. The visual indicator being a light source as well can accompany the sounds. In a competition or such, a competitor or judge can check indication via a scoring device either locally in the housing 10 or a remote location.

Figure 9:
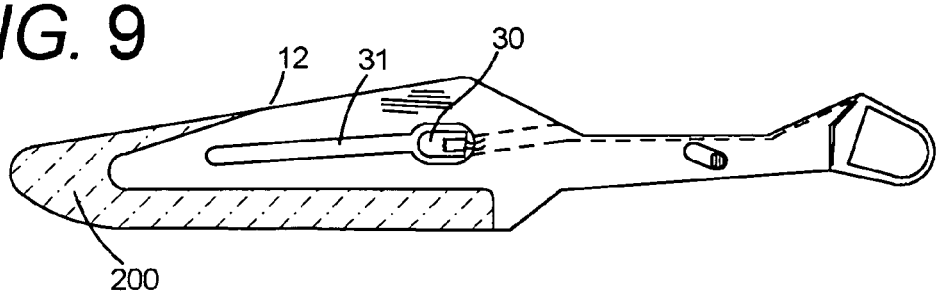
FIG. 9 is a perspective of one embodiment of an interchangeable element containing a resilient structure and a light source.
Figure 9A:
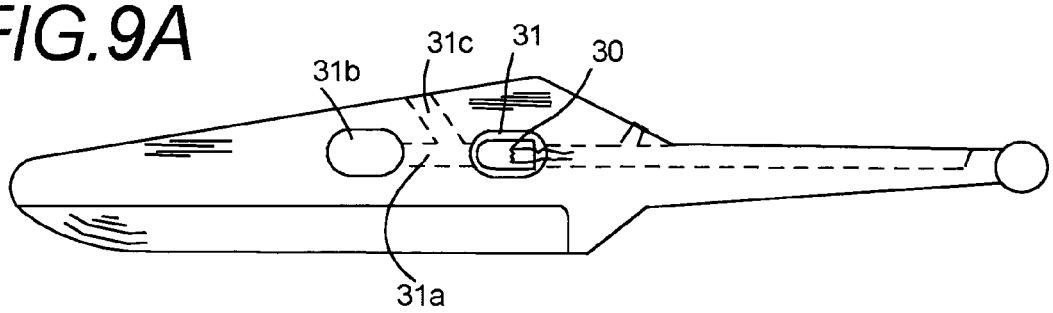
FIG. 9A is a perspective of one embodiment of an interchangeable element containing a light source illuminating a configuration of cutouts and ports.
Figure 9B:
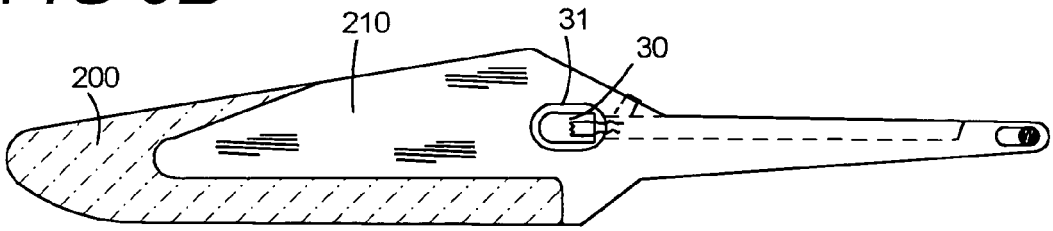
FIG. 9B is a perspective of one embodiment of an interchangeable element containing a partially light conducting material in combination with a resilient structure.
Figure 9C:
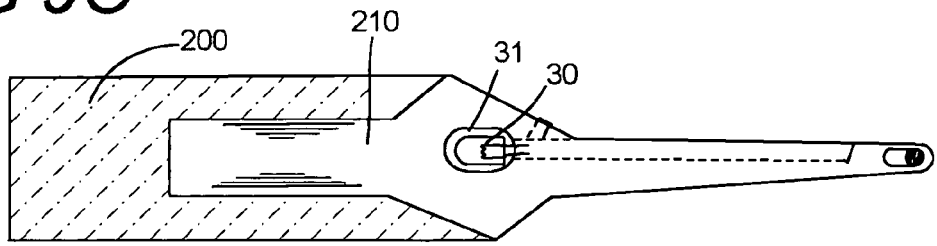
FIG. 9*c* is a perspective of one embodiment of an interchangeable element containing a partially light conducting material in combination with a resilient structure.

Referring now to the FIGS. 9 through 9*c* is shown a number of elements consisting of different structures that can be interchanged with other elements. The different tang connections are shown for illustration. Tang connections can be interchanged within the same tang connection or externally by design (not shown). FIG. 9 is an element containing the light source 30 mounted within the cutout 31 in the element 12 in combination with at least a partially resilient structure 200 to evade injury upon contact of the element 12. The resilient structure 200 in this embodiment is formed around the front and bottom edge section and can be any number of shapes and designs for aesthetic and functional reasons. In use, as the element contacts an object or body part the resilient structure 200 deflects to soften the impact.

FIG. 9A is an element showing another light indicating embodiment. The element is shown with the light source 30 mounted in the cutout 31. A cutout 31*b* is in longitudinal alignment and adjacent to cutout 31 connected by a port 31*a*. A port 31*c* starting at the port 31*a* continues on a bias to the edge of the element 12. In use upon activation the light source 30 shines into and through the port 31*a* and into the cutout 31*b* illuminating cutouts 31, 31*b* and port 31*a*. The light source 30 also shines into no less than one port 31*c* ending at the edge or edges of the element 12 illuminating the port(s) 31*c* providing a visual indication in response to movement of the element 12. This design enables a better vision of the light source when viewing the element from the edge.

FIG. 9B shows another embodiment of the element 12 consisting of at least a partially light conducting material 200. The element 12 is shown with the light source 30 mounted in the cutout 31 within the partially light conducting material 210. This embodiment is shown in combination with the partially resilient structure 200 formed around the front and bottom edge section of the element 12. In use as the light source is actuated the partially light conducting material is illuminated providing a visual indication in response to movement of the element 12.

FIG. 9C shows another embodiment of the element 12 consisting of the partially light conducting material 200. The element 12 is shown with the light source 30 mounted in the cutout 31 within at least a partially light conducting material 210. This embodiment is shown with the partially resilient structure 200 encompassing substantially all of the elements 12 circumferal edge. This structure presents a great deal of safety for use with heavy contact. The light conducting material 200 provides a visual indication in response to movement of the element 12.

CONCLUSION, RAMIFICATIONS AND SCOPE

Accordingly, the reader can see the simulated sharp edged weapon as described above provides realism and feedback while maintaining a degree of safety in a simulated sharp edged weapon. Accordingly, the invention provides a training weapon or toy that produces a clearly recognizable sensory signal or signals in response to a force acting on the element that can alert of contact or strike as well as being scored either locally or remotely from a distance. The invention is also expandable in use through the adaptation of different elements.

While my above description contains many specificities, these should not be construed as limitations on the scope of the invention, but rather as an exemplification of some presently preferred embodiments of this invention. Many other variations are possible. For example, different cam arrangements, pivot points, mechanisms and placements of such can be utilized. Many of the above teachings can be combined, interchanged or simplified while still being within the scope of the claims. An example being the element may be arranged to pivot or move in one direction only such that the indicating device is activated when a force is applied to the elements longitudinal edge only.

The element may also be arranged to deploy from and return into a sheathed housing by pivoting, sliding, folding, retracted, sprung or unsprung into and out of the housing. The simulated weapon or toy can contain a pocket clip or lanyard. The simulated edged weapon as described can be made from many materials and colors. The light source can be concealed within the housing, illuminate a different color(s) and overall designs can widely vary. The invention being mechanical and containing electronics can be made and arranged in countless configurations. Accordingly, the scope of the invention should be determined not by the embodiments illustrated, but by the appended claims and their legal equivalents.

I claim:

1. A contact-indicating device, comprising:

an elongate contact element extending along a longitudinal axis and including a contact portion and a tang portion;

a body configured to be grasped by a human hand, wherein the body includes an opening configured to receive the tang portion of the elongate contact element, the contact portion of the elongate contact element extends away from the body when the tang portion is received within the opening, and the opening and the tang portion are cooperatively configured to permit axial and transverse movement of the elongate contact element relative to the opening; and an electric circuit including a switch and an indicating element; and wherein:

axial movement of the elongate contact element relative to the opening closes the switch to complete the electric circuit;

transverse movement of the elongate contact element relative to the opening closes the switch to complete the electric circuit;

completing the electric circuit supplies power to the indicating element to provide a contact indication; and the tang portion of the elongate contact element is biased relative to the opening to open the switch and interrupt the supply of power to the indicating element.

2. The contact-indicating device of claim 1, wherein the tang portion is configured to move with the contact portion, and the permitted axial and transverse movement of the elongate contact element relative to the opening is substantially within a single plane.

3. The contact-indicating device of claim 1, wherein the switch comprises a first contact disposed on the tang portion and a second contact disposed on the body, axial movement of the elongate contact element relative to the opening moves the first contact into electrical contact with the second contact to close the switch, transverse movement of the elongate contact element relative to the opening moves the first contact into electrical contact with the second contact to close the switch, and the bias of the tang portion of the elongate contact element relative to the opening urges the first contact away from the second contact.

4. The contact-indicating device of claim 1, wherein the contact portion of the elongate contact element is configured to simulate at least one sharpened edge.

5. The contact-indicating device of claim 1, wherein at least a portion of the contact portion of the elongate contact element is fabricated from a resilient material.

6. The contact-indicating device of claim 1, wherein the tang portion of the elongate contact element includes a first wedge surface, the opening includes a second wedge surface, and axial movement of the elongate contact element relative to the opening causes the first wedge surface to engage and slide along the second wedge surface to cause transverse movement of the elongate contact element relative to the opening.

7. The contact-indicating device of claim 1, wherein the electric circuit includes a power source disposed within the body, and completing the electric circuit supplies power from the power source to the indicating element to provide a contact indication.

8. The contact-indicating device of claim 7, wherein the indicating element is disposed on the contact portion of the elongate contact element.

9. The contact-indicating device of claim 8, wherein the indicating element comprises a light emitting element, and the contact indication comprises light emitted from the light emitting element.

10. The contact-indicating device of claim 9, wherein the light emitting element is disposed within a recess on the contact portion of the elongate contact element.

11. The contact-indicating device of claim 9 wherein at least a portion of the contact portion of the elongate contact element is fabricated from a light conducting material, and the light emitting element is disposed proximate the light conducting material.

12. The contact-indicating device of claim 7, wherein the contact indication comprises a sound.

13. The contact-indicating device of claim 7, wherein the indicating element comprises a wireless transmitting device disposed within the body, and the contact indication comprises a transmission from the wireless transmitting device.

14. The contact-indicating device of claim 7, wherein the indicating element is a first indicating element and is disposed on the contact portion of the elongate contact element, the contact-indicating device comprises a second indicating element disposed on the body, and the second indicating element comprises a counter.

15. The contact-indicating device of claim 1, wherein the tang portion of the elongate contact element is biased relative to the opening by a shaped wire.

16. The contact-indicating device of claim 1, wherein the tang portion of the elongate contact element includes first and second transverse edges, the opening comprises an interior surface, and a resilient material separates the first and second transverse edges of the tang portion from corresponding portions of the interior surface.

17. A contact-indicating device, comprising:

a contact element extending along a longitudinal axis from a first end to a second end and including a contact portion proximate the first end and a tang portion proximate the second end, wherein the contact portion is configured to simulate at least one sharpened edge;

a handgrip, wherein the handgrip includes an opening configured to receive the tang portion of the contact element, the contact portion of the contact element extends away from the handgrip when the tang portion is received within the opening, and the opening and the tang portion are cooperatively configured to permit movement of the contact element relative to the handgrip and parallel to the longitudinal axis and to permit pivoting of the contact element relative to the handgrip;

a biasing element; and an electric circuit including a first contact disposed on the tang portion, a second contact disposed on the handgrip and an indicating element; and wherein:

movement of the contact element relative to the handgrip and parallel to the longitudinal axis moves the first contact into electrical contact with the second contact;

pivoting of the contact element relative to the handgrip moves the first contact into electrical contact with the second contact;

electrical contact between the first and second contacts completes the electric circuit and supplies power to the indicating element to provide a contact indication; and the biasing element urges the contact element to pivot relative to the handgrip and electrically separate the first and second contacts.

18. The contact-indicating device of claim 17, wherein the tang portion of the contact element is configured to move with the contact portion of the contact element, and the permitted pivoting of the contact element relative to the handgrip is substantially about a single axis transverse to the longitudinal axis.

19. The contact-indicating device of claim 17, wherein at least a portion of the contact portion of the contact element is fabricated from a resilient material.

20. The contact-indicating device of claim 17, wherein the tang portion of the contact element includes a first wedge surface, the opening includes a second wedge surface, and movement of the contact element relative to the handgrip and parallel to the longitudinal axis causes the first wedge surface to engage and slide along the second wedge surface to cause pivoting of the contact element relative to the handgrip.

21. The contact-indicating device of claim 17, wherein the electric circuit includes a power source disposed within the handgrip, and the indicating element is disposed on the contact portion of the contact element.

22. The contact-indicating device of claim 21, wherein the indicating element comprises a light emitting element, and the contact indication comprises light emitted from the light emitting element.

23. The contact-indicating device of claim 22, wherein the light emitting element is disposed within a cutout on the contact portion of the contact element.

24. The contact-indicating device of claim 22, wherein at least a portion of the contact portion of the contact element is fabricated from a light conducting material, and the light emitting element is disposed proximate the light conducting material.

25. The contact-indicating device of claim 17, wherein the electric circuit includes a power source disposed within the handgrip, and the contact indication comprises a sound.

26. The contact-indicating device of claim 17, wherein the indicating element comprises a wireless transmitting device disposed within the handgrip, and the contact indication comprises a transmission from the wireless transmitting device.

27. The contact-indicating device of claim 17, wherein the indicating element is a first indicating element and is disposed on the contact portion of the contact element, the contact-indicating device comprises a second indicating element disposed on the handgrip, and the second indicating element comprises a counter.

28. The contact-indicating device of claim 17, wherein the biasing element comprises a shaped wire disposed within the opening.

29. The contact-indicating device of claim 17, wherein the second end of the contact element includes an enlarged tip, the opening includes a socket configured to receive the enlarged tip, and the enlarged tip and socket are cooperatively configured to permit movement of the enlarged tip within the socket and parallel to the longitudinal axis and to permit pivoting of the contact element about the enlarged tip.

30. A contact-indicating device, comprising:

a blade element extending along a longitudinal axis from a first end to a second end and including a contact portion proximate the first end and a tang portion proximate the second end, with the tang portion being configured to move with the contact portion, wherein the contact portion is configured to simulate at least one sharpened edge, the tang portion includes a first wedge surface, and the second end of the blade element includes an enlarged tip;

a handle, wherein the handle includes a cutout configured to receive the tang portion of the blade element, the cutout includes a second wedge surface and a socket configured to receive the enlarged tip, the contact portion of the blade element extends away from the handle when the tang portion is received within the cutout, the cutout and the tang portion are cooperatively configured to permit pivoting of the blade element about the enlarged tip and to permit movement of the blade element relative to the cutout and along the longitudinal axis with the enlarged tip sliding within the socket, and movement of the blade element relative to the cutout and along the longitudinal axis causes the first wedge surface to engage and slide along the second wedge surface to cause pivoting of the blade element about the enlarged tip;

a biasing element; and an electric circuit including a sensor disposed on the handle proximate the cutout, a power source disposed within the handle, and an indicating element disposed on the contact portion of the blade element; and wherein:

movement of the blade element relative to the cutout and along the longitudinal axis activates the sensor;

pivoting of the blade element about the enlarged tip activates the sensor;

activating the sensor completes the electric circuit and supplies power from the power source to the indicating element to provide a contact indication; and the biasing element urges the blade element to pivot about the enlarged tip and deactivate the sensor.

31. The contact-indicating device of claim 30, wherein the permitted movement and pivoting of the blade element is substantially within a single plane.

32. The contact-indicating device of claim 30, wherein the sensor comprises a first contact disposed on the tang portion and a second contact disposed on the handle within the cutout, activating the sensor comprises moving the first contact into electrical contact with the second contact to complete the electric circuit, and deactivating the sensor comprises electrically separating the first and second contacts.

33. The contact-indicating device of claim 30, wherein the indicating element is a first indicating element, and the contact-indicating device comprises a second indicating element disposed on the handle.

34. The contact-indicating device of claim 33, wherein the first indicating element comprises a light emitting element, and the second indicating element is configured to emit a sound.

35. The contact-indicating device of claim 30, wherein at least a portion of the contact portion of the blade element comprises a resilient material.

* * * * *